United States Patent [19]

Sisler

[11] 4,069,596

[45] Jan. 24, 1978

[54] AIR SEAL ARRANGEMENT IN A CLOTHES DRYER

[75] Inventor: Robert R. Sisler, Louisville, Ky.

[73] Assignee: General Electric Company, Louisville, Ky.

[21] Appl. No.: 717,354

[22] Filed: Aug. 24, 1976

[51] Int. Cl.[2] ..... F26B 25/00

[52] U.S. Cl. ..... 34/242; 34/133

[58] Field of Search ..... 34/133, 139, 242; 432/115, 242; 277/229

[56] References Cited

U.S. PATENT DOCUMENTS

| | | | |
|---|---|---|---|
| 2,751,688 | 6/1956 | Douglas | 34/133 |
| 2,802,282 | 8/1957 | Buck | 34/133 |
| 3,875,686 | 4/1975 | Smoot | 34/242 |

*Primary Examiner*—Kenneth W. Sprague
*Assistant Examiner*—James C. Yeung
*Attorney, Agent, or Firm*—Frederick P. Weidner; Francis H. Boos

[57] ABSTRACT

An air seal arrangement in a clothes dryer having a cabinet housing a rotatable drum, the drum having a front wall with a loading opening therethrough and the cabinet having an access opening larger than the drum loading opening. There is a circular seal ring having a circumferential area tapered inwardly and the ring extends from the cabinet front through the access opening of the cabinet into the loading opening of the drum. A seal is provided having an area attached to the front wall of the drum circumferentially around the loading opening and a flexible area extending from the attached area toward the front of the cabinet. The seal ring and seal cooperate and overlappingly engage each other at the tapered area of the seal ring and the flexible area of the seal to provide the air seal.

5 Claims, 2 Drawing Figures

AIR SEAL ARRANGEMENT IN A CLOTHES DRYER

BACKGROUND OF THE INVENTION

Field of the Invention

This invention relates generally to automatic clothes dryers and more particularly to an improved air seal arrangement in automatic clothes dryers.

Present clothes dryer seals are formed of a relatively thick ring of felt stuffed and lodged into place between the housing and the drum to bear against the drum as it rotates. Such a seal arrangement is shown in U.S. Pat. No. 3,436,838 assigned to the same assignee as the present invention. Seals are necessary to prevent air leakage between the drum and the clothes dryer cabinet which could detrimentally affect the air flow system of the clothes dryer. Such seals are difficult to establish, particularly in mass produced clothes dryers wherein the tolerances between the stationary and moving components can vary. This is particularly true when the seal is to be effective between a large diameter rotating drum, such as in a clothes dryer. It is desirable that the sealing characteristics be effective but without having the seal exert too much force against the rotating drum thus either causing a slowdown of the drum or an excessive burden on the components that drive the drum at a preferred given speed in order to obtain optimum drying characteristics.

In addition to the above consideration, one of the difficulties in prior clothes dryer seal arrangements is that the assembly of the clothes dryer necessarily involved a "blind" assembly of the seal with the drum and it could not be determined if the seal was in its proper position against the drum. It is therefore highly desirable to have a seal arrangement so that during assembly of the clothes dryer it can be determined visually whether or not the seal is in its proper position to assure maximum sealing characteristics.

It is also advantageous to have a seal arrangement that prevents any lubricant or worn material particles from the supports that hold the front of the drum and allow it to rotate from being introduced into the interior of the drum where it might come in contact with the clean dried clothes.

By my invention there is provided an improved air seal arrangement for clothes dryers that will accomplish the above mentioned desirable characteristics.

SUMMARY OF THE INVENTION

There is provided an improved air seal arrangement in a clothes dryer having a cabinet structure housing a rotatable drum having a front wall with a loading opening therethrough. The cabinet housing has an access opening larger than the loading opening of the drum and there is provided a door for closing the access opening.

This invention relates to utilizing a seal ring having a circumferential area tapered inwardly, the ring extending from the cabinet front through the access opening of the cabinet and into the loading opening of the drum. There is a seal having an area attached to the front wall of the drum and extending circumferentially around the loading opening, the seal having a flexible area extending from the attached area toward the front of the dryer cabinet; said seal ring and seal cooperating to overlappingly engage each other at the tapered area of the seal ring and the flexible area of the seal with the seal ring being inside the seal.

DESCRIPTION OF THE PREFERRED EMBODIMENT

Figure 1:
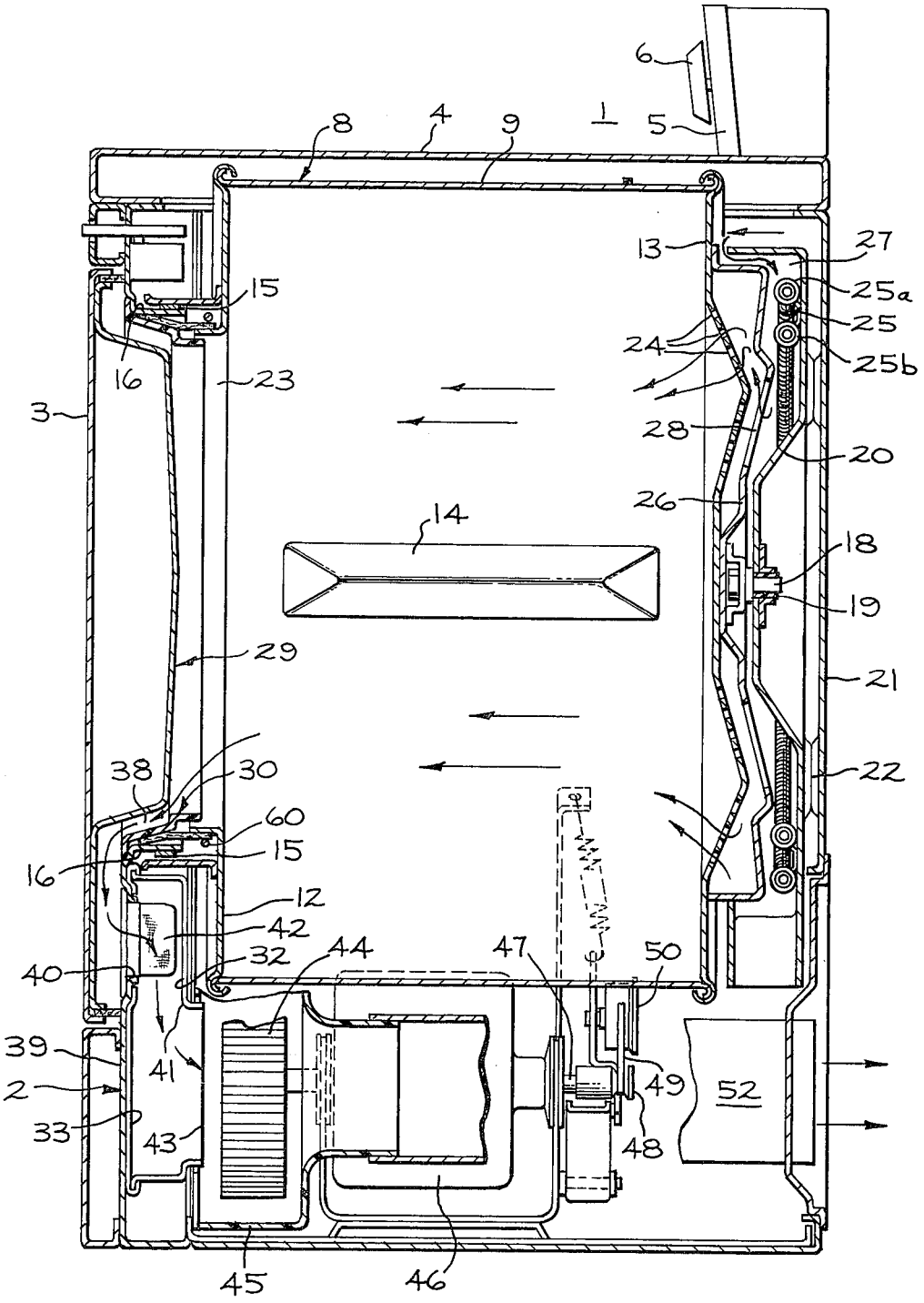
FIG. 1 is a side elevational view of an automatic clothes dryer incorporating the improved air seal arrangement of the present invention, the view being partly broken away and partly in section to illustrate details.

Referring now to FIG. 1, the machine illustrated is a domestic clothes dryer generally indicated by the numeral 1. Dryer 1 is provided, in the usual way, with a cabinet 2 having a front door 3 to provide access to the interior of the cabinet. Provided on the top wall 4 of the cabinet 2 is a control panel 5 which may include a suitable manual control 6. By manual manipulation of control 6 the machine can be caused to start and automatically proceed through a cycle of operation.

Within cabinet 2 there is provided a fabric tumbling chamber, or drum 8, mounted for rotation on a substantially horizontal axis. Drum 8 is generally cylindrical in shape having a first, outer imperforate cylindrical wall portion 9, a front wall 12 and a back wall 13. A plurality of clothes tumbling ribs 14 are provided on the interior of wall portion 9 to lift fabrics as the drum rotates, and then allow them to tumble back to the bottom of the drum.

The front of drum 8 is rotatably supported within the cabinet 2 by suitable fixed support means such as the slides shown at 15. These slides are mounted on a depending flange member 16, which extends inwardly in the direction of the drum, and formed as part of the cabinet 2. The slides are arranged to contact a depending flange 17 on the front wall 12 of the drum so as to provide a support for the front of the drum. The rear end of drum 8 receives support by means of a stub shaft 18 extending from the center of wall 13. Shaft 18 is secured within a bearing 19 supported by a baffle 20 which, in turn, is rigidly secured to the back wall 21 of cabinet 2 by any suitable means such as welding at a number of points 22. With this arrangement, the drum rotates about a horizontal axis with slides 15 providing the front support and stub shaft 18 within bearing 19 providing the rear support.

In order to provide for the flow of a stream of drying air through the clothes dryer (as shown by arrows in FIG. 1), the drum is provided with a central aperture or loading opening 23 in its front wall 12 and with an opening in the form of a plurality of perforations 24 in its rear wall 13. Baffle member 20 also supports heating means 25, which includes two electrical resistance heating elements **25*a* and 25*b*, appropriately insulated from the baffle. A second baffle member 26 is secured to the back wall 13 of the drum outside the ring of perforations 24 and within the stationary baffle 20, so that an annular air inlet 27 is, in effect, formed by baffles 20 and 26. In this manner a passage is formed for air to enter the annular inlet opening 27 between the baffles, pass over the heating means 25, pass through openings 28 formed in baffle 26, and through the perforations 24 to the interior of the drum 8**.

The front opening 23 of the drum is substantially closed by means of a bulkhead generally indicated by the numeral 29 and is formed as part of the inner surface of access door 3. The front opening 23 air sealing components and their cooperative arrangement will be discussed later in connection with FIG. 2. A suitable clearance is provided between the inner edge of the drum opening 23 and the edge of bulkhead 29 so that there will be no rubbing between the drum and bulkhead during rotation of the drum.

Front opening 23 also serves in addition to allowing air to flow out the front, as a means whereby clothes may be loaded into and unloaded from the drum. Door 3 is mounted on cabinet 2 so that when the door is open, clothes may be inserted into or removed from the drum.

The air outlet from the drum is provided by an opening 38 formed between the bulkhead 29 and a seal ring 30. The bottom wall section of the cabinet 2 has an opening 40 that provides the entrance to the duct 41 formed by the cooperation of members 32 and 33. A lint trap 42 is positioned in the exhaust duct 41 at the opening 40, the trap being supported by the cabinet front wall 39.

Duct 41 leads downwardly to an opening 43. Opening 43 constitutes the inlet to a blower member 44, contained within a housing 45 and directly driven by an electric motor 46. The blower brings air over the heater means 25, through the drum 8, through the space 38 between the door bulkhead 29 and seal ring 30, duct 41, and then into the blower. From the blower 44 the air passes through an appropriate duct 52 out of cabinet 2 so as to be exhausted from the machine.

In addition to driving blower 44, motor 46 constitutes a cyclically moving means for rotating the drum to tumble fabrics. To effect this rotation, motor 46 is provided with a shaft 47 having a small pulley 48 formed at the end thereof. A belt 49 extends around the pulley and completely around the cylindrical wall 9 of the drum 8. The relative circumferences of pulley 48 and wall section 9 cause the drum to be driven at a speed suitable to effect tumbling of the fabrics within the drum. A suitable idler assembly 50 provides proper tensioning of the belt 49. Thus, operation of the motor both causes the fabrics to be tumbled within the drum and air to be forced through the drum. When the air is heated by heating elements **25*a* and 25*b***, the heated air passing through the drum causes vaporization of the moisture from the fabrics and the vapor is carried off with the air as it passes out of the machine.

Figure 2:
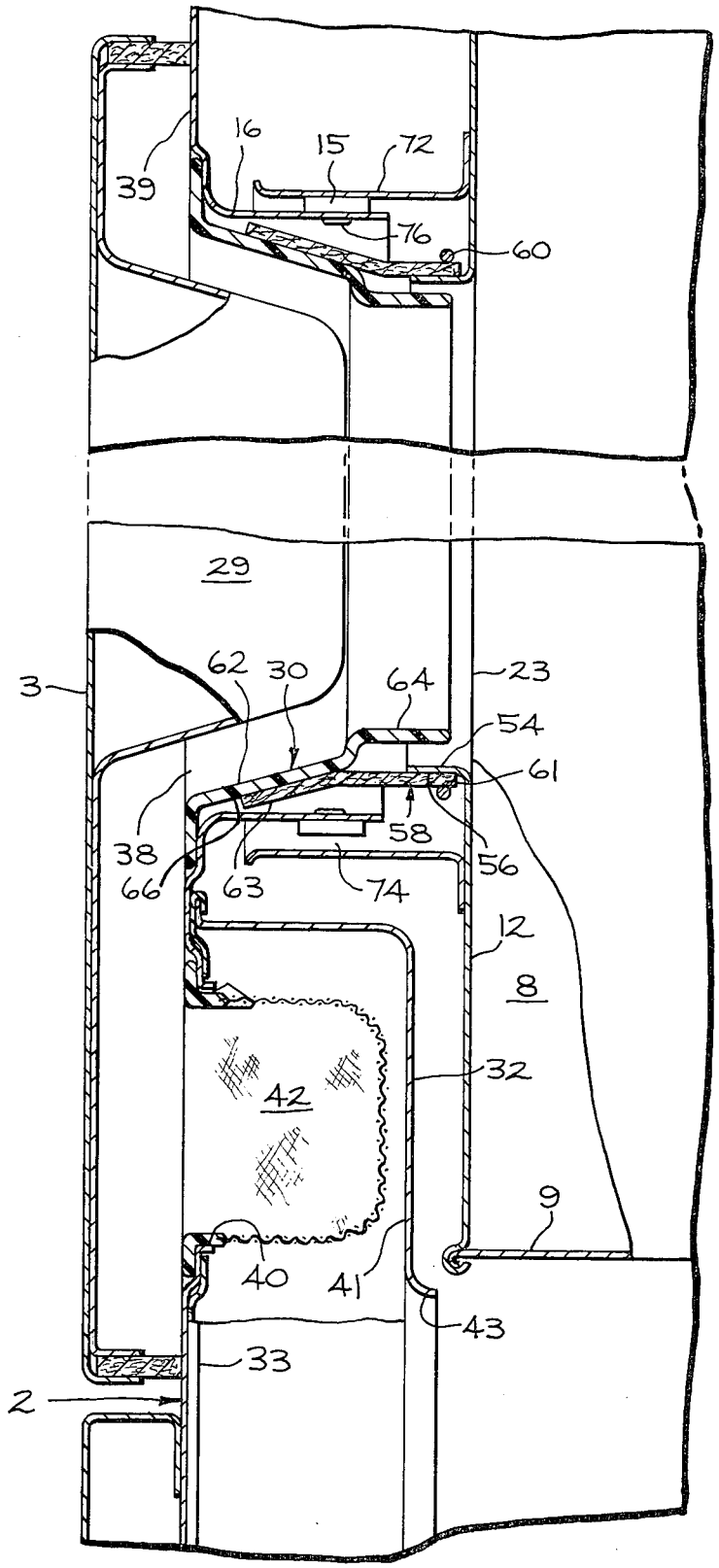
FIG. 2 is an enlarged side elevational view partly in section illustrating various details of the air seal arrangement of the present invention.

With reference specifically to FIG. 2, the details of the improved air sealing arrangement incorporated in the above-described clothes dryer will now be discussed. The front wall 12 of the drum 8 provides for the loading opening 23 by a circular outwardly directed depending flange 54 which in effect defines the loading opening. On the outside surface 56 of the flange 54 there is attached a seal 58 which may be made of any flexible material suitable under conditions which the seal is to operate and in most cases the material is felt. Felt has been used as a sealing material for such applications in clothes dryers and is generally quite satisfactory. The seal 58 may be attached to the outside surface 56 of flange 54 by any suitable means and in the preferred embodiment the attachment is by a circumferential wire 60 that presses on area 61 of the seal against the flange 54 and retains it in place on the flange. The rest of the steel is a flexible area 63 and extends from the attached area 61 toward the front of the cabinet. The air sealing arrangement also includes the seal ring 30 which again may be made from suitable material and in the case of the preferred embodiment it is a plastic molded ring which has an area 62 slanted or tapered inwardly and a second area 64 substantially parallel to the axis of the drum opening 23. During assembly of the clothes dryer the seal ring 30 is installed after the drum 8 carrying the seal 58 is in place within the cabinet 2. By placing the seal ring 30 into the access opening of the cabinet the exterior surface 66 of the tapered area 62 will engage the flexible area 63 of seal 58 and by continuing moving the seal ring 30 inwardly the flexible area 63 is caused to deflect outwardly and when the seal ring 30 is in its proper position as shown in FIG. 2, the tapered area 62 and the flexible area 63 of the seal will be overlapping and in cooperative engagement with each other to provide good air seal characteristics. It will be noted by this seal arrangement that if there is any difficulty in the proper assembly of the sealing components that it may be visually detected since the seal must be correctly positioned, otherwise it could be visually seen from inside the seal ring 30.

The front wall 12 of the drum 8 also has a second outwardly depending flange 72 attached thereto as by welding and that flange surrounds the outwardly depending flange 54 that defines loading spring 23 and carries the seal 58. The cabinet front wall 39 has an inwardly directed flange member 16 which carries a plurality of fixed slides 15 and these slides act to support the front of the drum by the circular second depending flange 72 riding thereon. As can be seen in the top portion of FIG. 2, the second depending flange 72 will be bearing upon the slide 15 at the top of the drum whereas if there is any dimensional tolerance deviation these components will be separated at the bottom of the drum and this separation is shown as space 74 at the bottom of FIG. 2 in particular. Therefore, the drum is supported at the front at the top thereof in cooperation with the inwardly depending flange 16 of the cabinet 2, slides 15 secured thereto as by rivet 76 and the second depending flange 72 attached to front wall 12 of the drum 8. By having the air seal arrangement as described above and the front drum support arrangement, any lubricant or worn material as a result of the movement of the drum on the slides will not be able to be introduced into the interior of the drum where it might come in contact with the clean dried clothes. This would, of course, also be true if the drum was supported on slides located elsewhere on the flange member 16 should such slide locations be desirable.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. An improved air seal arrangement in a clothes dryer having a cabinet structure housing a rotatable drum, said drum having a front wall with a loading opening therethrough, said cabinet having an access opening larger than the drum loading opening, the improvement comprising:

a first outwardly depending flange on the front wall of the drum defining the loading opening, fixed drum support means, a second outwardly depending flange circumferentially around the first depending flange, said second depending flange cooperating with the fixed drum support means to support the front of the drum, a circular seal ring having a circumferential area tapered inwardly, said ring extending from the cabinet front through the access opening of the cabinet and into the loading opening of the drum, a seal having an area attached to the first depending flange of the front wall of the drum circumferentially around the loading opening and a flexible area extending from the attached area toward the front of the cabinet, and said seal ring and seal cooperating to overlappingly engage each other at the tapered area of the seal ring and flexible area of the seal with the seal ring being inside the seal.

2. The improved air seal arrangement of claim 1 wherein the seal is made of felt material.

3. The improved air seal arrangement of claim 1 wherein the seal is attached to the outwardly depending flange by a circumferential wire.

4. The improved air seal arrangement of claim 1 wherein the fixed support means are a plurality of slides around and located inside the second flange.

5. The improved air seal arrangement of claim 4 wherein the cabinet has an inwardly directed flange forming the access opening and said cabinet flange and said second front drum wall flange overlie each other and the slides are fixed to the cabinet flange.

* * * * *